US006817471B2

(12) United States Patent
Harris et al.

(10) Patent No.: US 6,817,471 B2
(45) Date of Patent: Nov. 16, 2004

(54) DISPLAY CONTAINER

(75) Inventors: David K. Harris, Nashua, NH (US); Rudy Woodard, Boston, MA (US)

(73) Assignee: Brookstone Purchasing, Inc., Merrimack, NH (US)

( * ) Notice: Subject to any disclaimer, the term of this patent is extended or adjusted under 35 U.S.C. 154(b) by 9 days.

(21) Appl. No.: 09/976,418

(22) Filed: Oct. 12, 2001

(65) Prior Publication Data

US 2003/0070949 A1 Apr. 17, 2003

(51) Int. Cl.[7] ..... A45C 11/26

(52) U.S. Cl. ..... 206/349; 206/459.5

(58) Field of Search ..... 206/349, 372, 206/373, 775, 776, 778, 460, 523, 459.5, 303, 449, 232, 457, 37, 38, 408, 413; 220/8, 521, 522, 526, 532, 533, 916, 529; 229/5.5, 5.6, 5.7, 5.8, 93, 67, 921

(56) References Cited

U.S. PATENT DOCUMENTS 1,032,282 A * 7/1912 Hay ..... 229/921
2,000,419 A * 5/1935 Sarber ..... 40/311
2,274,196 A * 2/1942 Gilbert ..... 220/529
2,646,278 A * 7/1953 Wilson ..... 206/37
2,974,825 A * 3/1961 Ross ..... 206/37
3,077,981 A * 2/1963 Gaspard ..... 206/459.5
3,241,661 A * 3/1966 Zamzow et al. ..... 206/433
3,306,266 A * 2/1967 McCunney ..... 206/37
3,750,871 A * 8/1973 Cook ..... 206/523
3,913,774 A 10/1975 Vajtay
4,191,321 A 3/1980 Samsing
4,534,126 A * 8/1985 Gilman ..... 40/19
4,593,816 A * 6/1986 Langenbeck ..... 206/425
4,700,883 A 10/1987 Vajtay et al.
4,726,469 A * 2/1988 Farber ..... 206/493
4,753,340 A * 6/1988 Blakeman et al. ..... 206/459.5
5,038,927 A * 8/1991 Bell ..... 206/776
5,211,206 A * 5/1993 LaBonte et al. ..... 138/89
5,221,004 A * 6/1993 Murphy ..... 206/314
5,379,892 A * 1/1995 Reams et al. ..... 206/315.9
5,450,926 A * 9/1995 Fraser ..... 206/459.1
5,645,329 A * 7/1997 Madock ..... 312/9.63
5,711,446 A * 1/1998 Jeffs et al. ..... 220/23.83
5,762,194 A * 6/1998 Clegg ..... 206/449
6,276,528 B1 * 8/2001 Nowotny et al. ..... 206/397
6,557,750 B1 * 5/2003 Druse et al. ..... 229/162

* cited by examiner

*Primary Examiner*—Shian T. Luong
(74) *Attorney, Agent, or Firm*—Nixon Peabody LLP

(57) ABSTRACT

A display container is disclosed having a pair of end caps coupleable to a central portion and a merchandising card extending between and secured in position by the end caps. The merchandising card capable of supporting an item to be sold. The central portion may be transparent to allow a consumer to see the item for sale.

23 Claims, 6 Drawing Sheets

DISPLAY CONTAINER

FIELD OF THE INVENTION

The invention relates to packaging, and more particularly relates to merchandising display packaging.

BACKGROUND OF THE INVENTION

Various merchandising display packages or containers are known in the art. For example, U.S. Pat. No. 3,913,774 discloses a container having tubular central sections and rigid end caps and that various techniques have been employed for joining these items such as adhesive, tape, frictional engagement, staples, and other fastening materials. The '774 patent discloses a container having a central section forming sides in positive engagement with a pair of rigid end caps. The '774 patent further discloses that the central section may have a cross-sectional shape such as circular or rectangular and may be cut to any desired length. U.S. Pat. No. 4,191,321 discloses an oval shaped thermo plastic central section having paperboard end caps inserted in the ends of the central section to form a container. And, U.S. Pat. No. 4,700,883 discloses packaging having rigid end caps for engaging with rectangular tubes formed from a flexible, semi-rigid sheet stock. Tabs formed as part of the end caps engage with slots formed in the rectangular tubes.

BRIEF SUMMARY OF THE INVENTION

The present invention provides an improvement over the aforesaid prior art packaging. In accordance with one embodiment of the present invention, a novel merchandising display package or container is disclosed having a first and a second end cap, a central portion coupled to the first and the second end caps, and a member extending between and secured in position by the end caps.

In a second embodiment a display package or container for displaying items is disclosed having a first and a second end cap, with each end cap comprising a depression shaped to secure the item to be displayed, and a central portion coupled to the first and the second end caps.

BRIEF DESCRIPTION OF THE DRAWINGS

Further details of the present invention will be seen from the following detailed description, taken in conjunction with the drawings, wherein like numerals depict like parts, and wherein.

DETAILED DESCRIPTION OF EMBODIMENTS OF THE INVENTION

Figure 1:
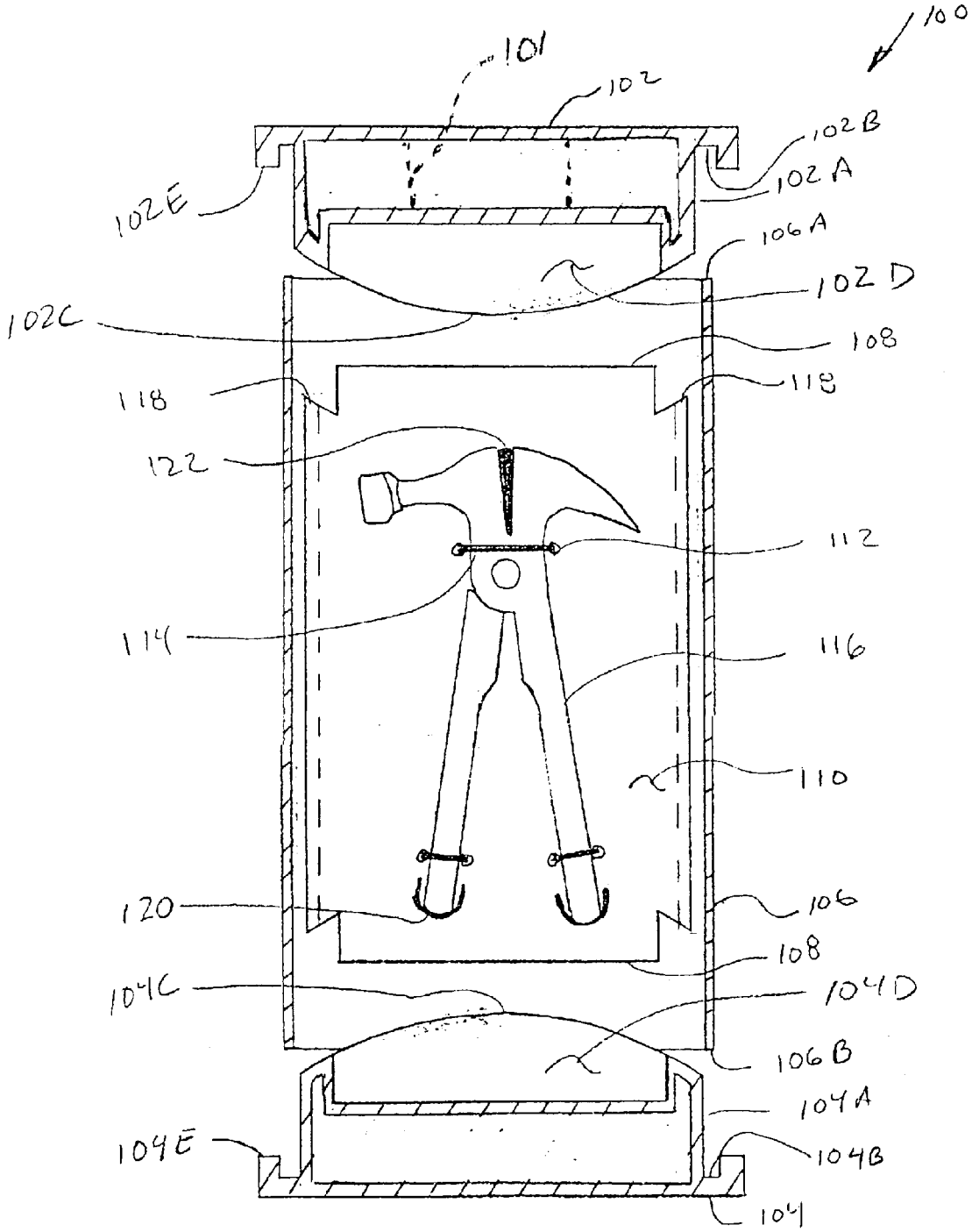
FIG. 1 shows a front sectional view of a first exemplary package consistent with the present invention.

FIG. 1 shows a first embodiment of container 100. The container 100 may used to display an item 116 for sale. The container 100 comprises a first end cap 102, a second end cap 104, a central portion 106, and a merchandise card 110. The end caps 102/104 may be molded, for example blow molded, and may have a predetermined cross section. Alternatively, the end caps 102/104 may be formed from a metal or any paper product including cardboard. The cross section of the end caps 102/104 may comprises a cross section selected from the group consisting of an oval, a circle, an ellipse, a square, and a polygon. The end caps 102/104 may comprise a groove 102B/104B enclosed inside of a lip 102E/104E. The end caps 102/104 may comprise an opening 102D/104D, for example a slot, for securing a merchandise card 110, upon which in turn is secured an item 116 for sale. Merchandise card 110 also can carry graphics or other information about the item for sale, instructions, etc. The opening 102D/104D is shown as a slot extending along a straight line. Alternatively, the opening may be curved. The bottom of the top end cap 102 may comprise a curved surface 102C. Alternatively, the bottom of the top end cap may comprise a flat surface that may or may not be parallel with the top surface of the top end cap. Preferably, the top end cap and the bottom end cap are similarly shaped and interchangeable. Alternatively, the top and bottom end caps 102 and 104 may be different.

Figure 10:
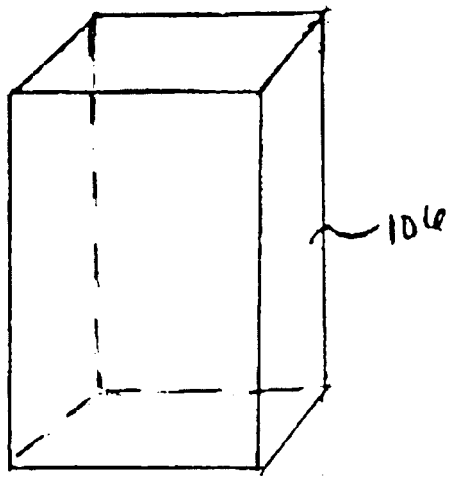
FIG. 10 shows a side elevational view of a first embodiment of the central portion consistent with the present invention.
Figure 11:
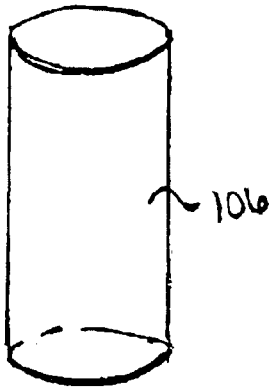
FIG. 11 shows a side elevational view of a second embodiment of the central portion consistent with the present invention.
Figure 12:
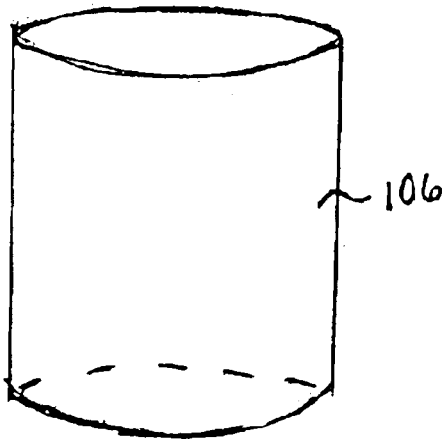
FIG. 12 shows a side elevational view of a third embodiment of the central portion consistent with the present invention.

The central portion 106 may be formed in a tube from a thin flexible thermoplastic material having a preferred thickness of 0.005 to 0.050". Of course thicker or thinner material may be used depending on the size and/or weight of the container. The central portion 106 preferably is transparent. The central portion 106 may have a cross section similar to the cross section of the end caps 102 and 104 as shown in FIGS. 10, 11 and 12. Ends 106A and 106B of the central portion 106 may fit in the groove 102B or 104B in end caps 102 and 104 respectively. The central portion 106 may be positively coupled to the end caps 102 and 104, as will be discussed below. The central portion 106 may be extruded into its final form or may be formed by rolling or creasing a piece of flexible thermoplastic sheet stock into a desired cross section and gluing or otherwise securing the ends together. The central portion 106 may be formed in any length. A plane formed by the ends 106A and 106B may be perpendicular to the side of the central portion. The ends 106A and 106B alternatively may be other than perpendicular to the sides of the central portion or may have a nonlinear contour.

The merchandise card 110 may be a rigid planar structure formed of a thermoplastic. Alternatively, the merchandise card may be formed from a metal or any paper product including cardboard. The merchandise card 110 need not be planar, but may have a contour to match the opening 102D/104D in the end caps 102 and 104 respectively. The merchandise card 110 may include stiffening ribs 118. An item 116 to be sold may be secured to the merchandise card 110 by plastic or metal ties or string 114 that extend through openings 112 in the merchandise card 110, or could be affixed to the card by glue or shrink wrap, etc. The merchandise card 110 may further comprise protrusions 120 and 122 to assist in the securing of the item 116. Alternatively, the merchandise card 110 may further comprise indentations in which the item 116 is set. The merchandise card 110 may comprise ends 108 that may be inserted in openings 102D and 104D respectively in the end caps 102 and 104 respectively. The opening 102D and 104D may be shaped to frictionally engage the ends 108 of the merchandise card 110. When the end caps 102/104 are secured to the central portion 106, the merchandise card 110 may extend from the bottom end cap 104 to the top end cap 102. Alternatively, the merchandise card 110 may be secured in place only by the lower end cap 104.

Figure 2:
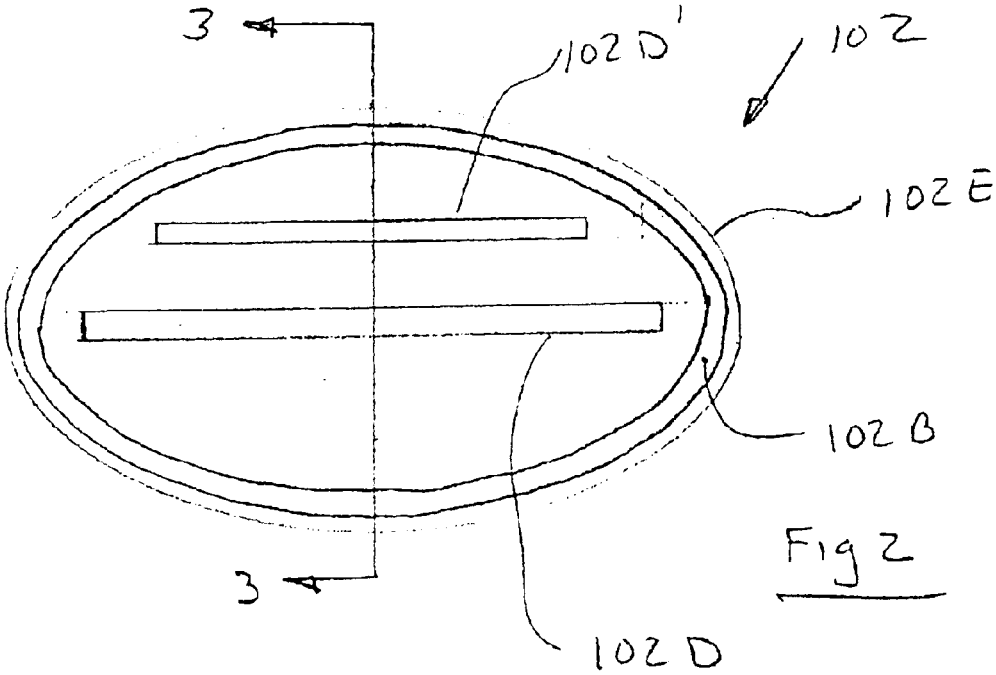
FIG. 2 shows a bottom view of an end cap of the novel package of FIG. 1.
Figure 3:
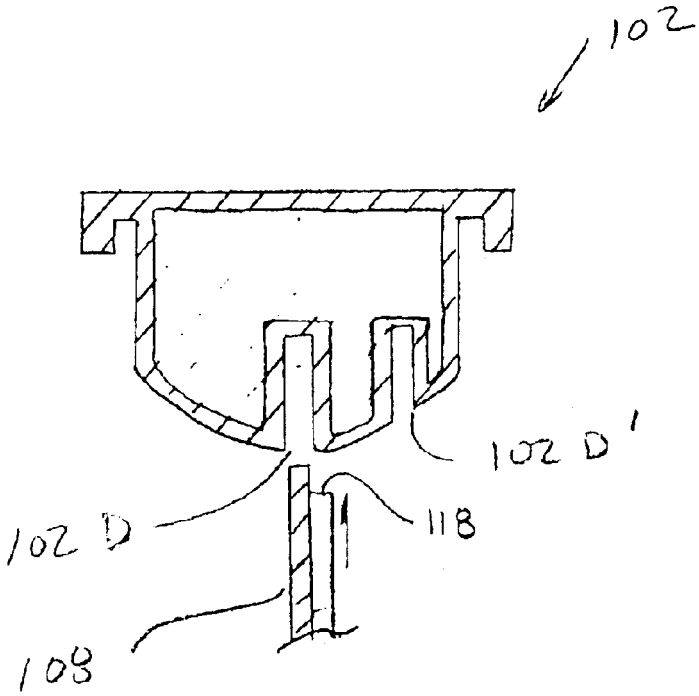
FIG. 3 shows a side sectional view of the end cap of FIG. 2 taken through line 3—3 in FIG. 2.

As shown in FIGS. 2 and 3, the opening 102D may be located along the centerline of the end cap 102. Alternatively, an opening 102D' may be offset from the centerline of the end cap.

Figure 4:
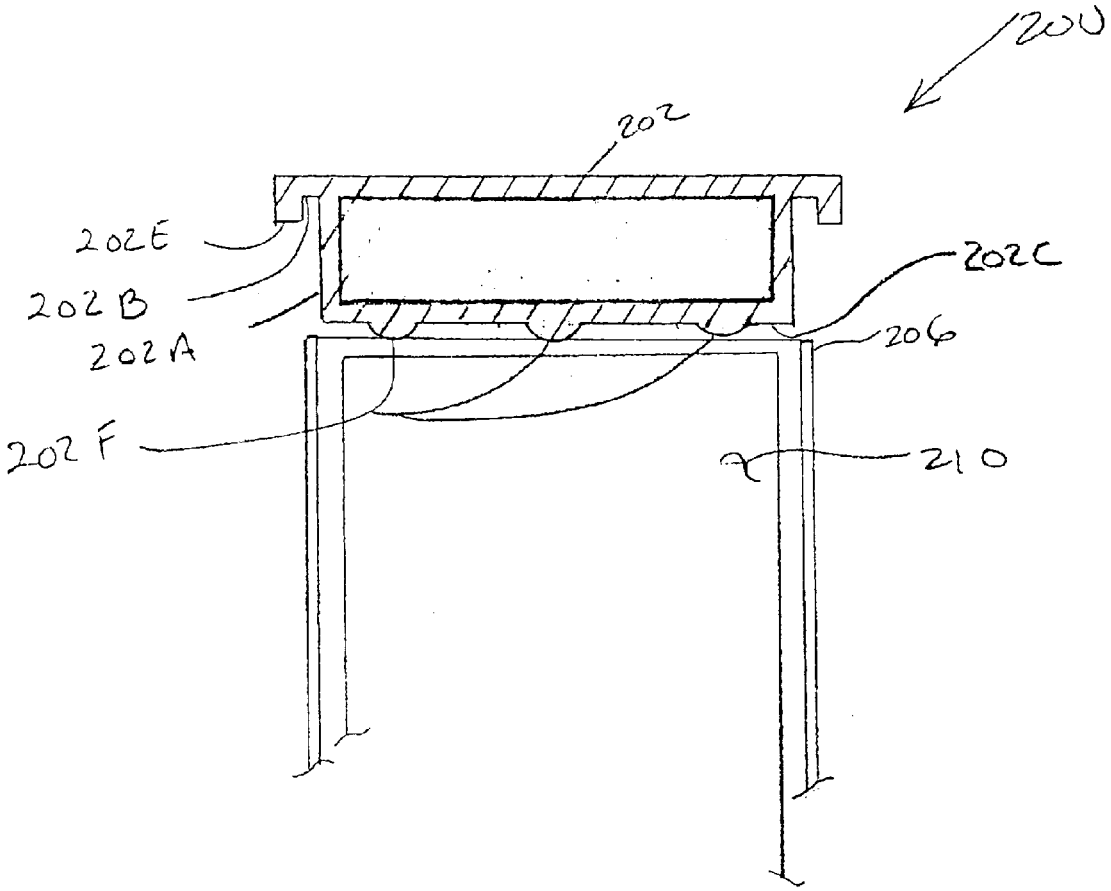
FIG. 4 shows a partial front sectional view of a second exemplary package consistent with the present invention.
Figure 5:
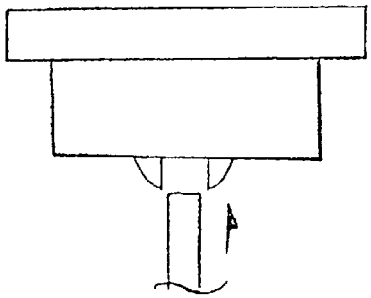
FIG. 5 shows a side view of an end cap of FIG. 4.

FIG. 4 shows a second embodiment container 200. The container 200 may be used to display an item for sale. The container 200 comprises a first end cap 202, a second end cap 204 (not shown), a central portion 206, and a merchandise card 210. The end caps 204/206 may be molded, for example blow molded, and may have a predetermined cross section. Alternatively, the end caps 202/204 may be formed from a metal or any paper product including cardboard. The cross section of the end caps 202/204 should mirror that of central portion 206, and thus typically will be an oval, a circle, an ellipse, a rectangle or a polygon. The end caps 202/204 may comprise a groove 202B/204B enclosed inside of a lip 202E/204E. The bottom of the top end cap 202 may comprise a generally flat surface 202C that may or may not be parallel with the top surface of the top end cap 202. The generally flat surface 202C may comprise a plurality of protrusions 202F. As shown in FIG. 5, the protrusions 202 may be spaced apart to allow the merchandise card 210 to be secured therein. The protrusion can be any shape including half circles and wedges. The protrusion may be aligned in a straight line or along a curve to match the merchandise card 210. The protrusion may be on a top end cap having a non-planar surface bottom surface. Likewise, the bottom end cap may be similarly shaped. Alternatively, the top and bottom end caps 202 and 204 may not be similarly shaped. A container may be formed using a combination of ends caps 102/104 and 202/204.

Figure 6:
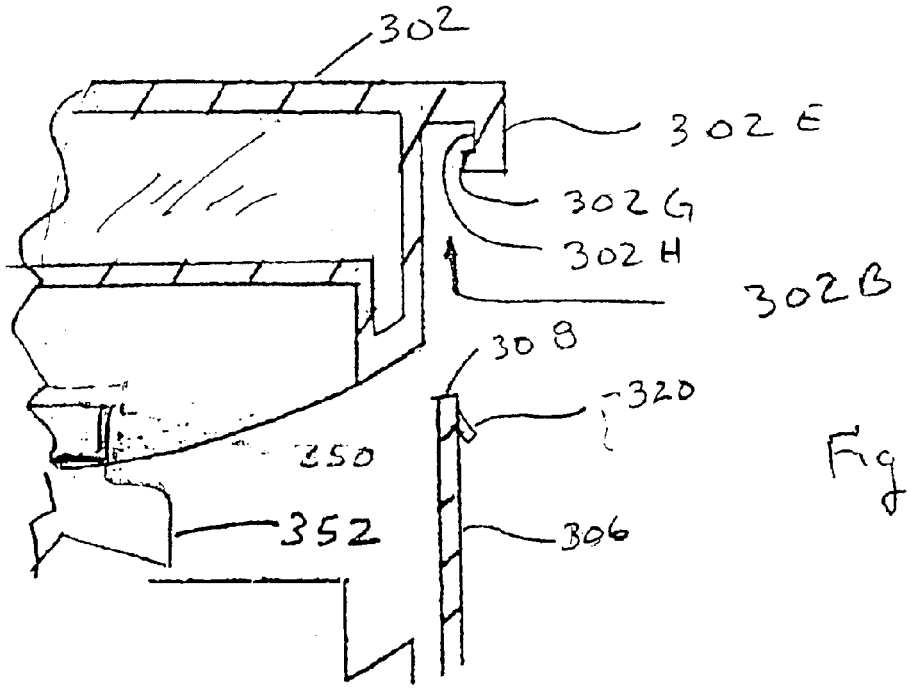
FIG. 6 shows a partial front sectional view of a first embodiment for joining an end cap and a tube consistent with the present invention.

FIGS. 6–9 discloses several different methods for securing the central portion to the end caps. In FIG. 6, a central portion 306 comprises a protrusion 320, for example a barb, disposed near an end 308. An end cap 302 comprises a groove 302B, a first lip 302E and a second lip 302G. The second lip 302G forms an undercut portion 302H. When the central portion 306 is inserted in the groove 302B, the barb 320 extends into undercut portion 302H and the lip 302G helps prevents the central portion 306 from being extracted from the groove 302B. Also, end cap 302 may include a recess, shown in phantom at 350, in which an item to be displayed, e.g. bottle 350, is secured.

Figure 7:
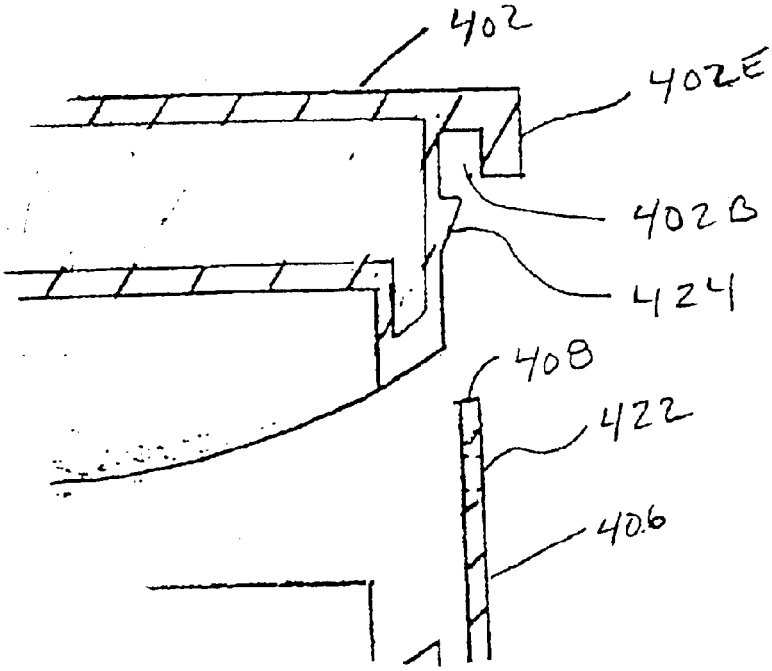
FIG. 7 shows a partial front sectional view of a second embodiment for joining an end cap and a tube consistent with the present invention.

In FIG. 7, a central portion 406 comprises an opening 422 disposed near an end 408. An end cap 402 comprises a groove 402B, a lip 402E and a protrusion 424. When the central portion 406 is inserted in the groove 402B, the protrusion 424 extends into the opening 422 in the central portion 406. The protrusion helps prevents the central portion 406 from being extracted from the groove 402B.

Figure 8:
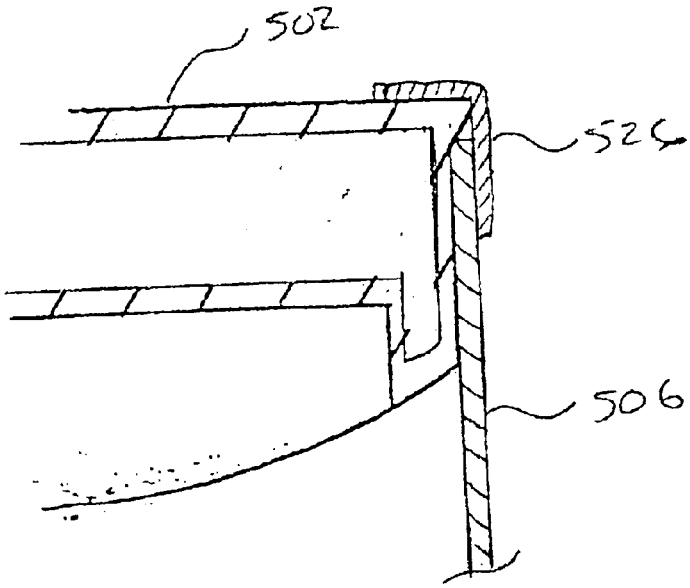
FIG. 8 shows a partial front sectional view of a third embodiment for joining an end cap and a tube consistent with the present invention.

In FIG. 8, the end cap 502 is secured to the central portion 506 with a section of adhesive tape 526.

Figure 9:
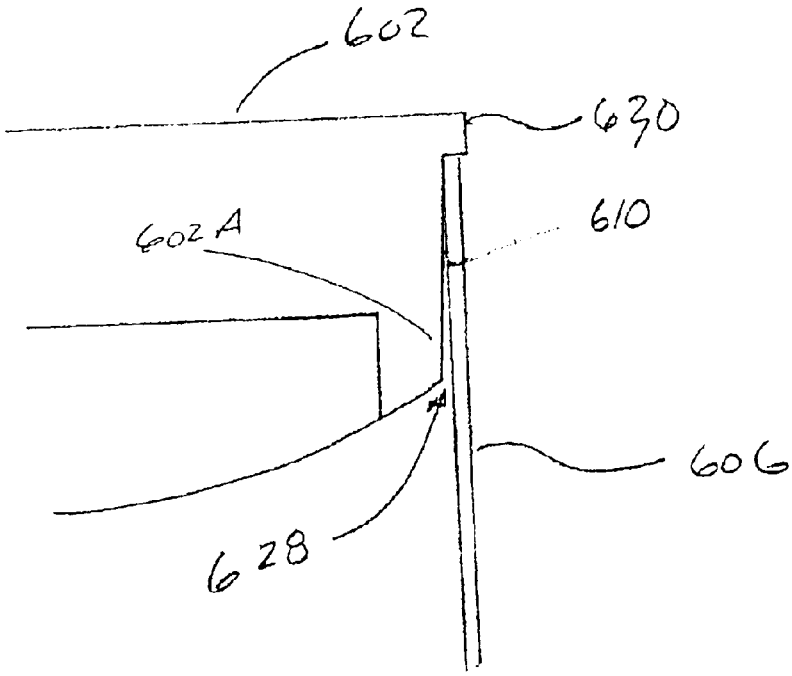
FIG. 9 shows a partial front sectional view of a fourth embodiment for joining an end cap and a tube consistent with the present invention.

In FIG. 9, the end cap 602 comprises a sidewall 602A with 1° to 20° of draft to the top surface. The draft leaves a gap 628. The central portion 606 is frictionally secured to the end cap 602. Alternatively, the end cap 602 and the central portion 606 may be joined using an adhesive at 610.

A feature and advantage of the present invention is that the container also may function as a shipping container, and protects the merchandise during shipping and handling, without the need for extraneous packing material which would need to be disposed of. Thus, the container may be used for shipping and displaying a variety of goods, including tools, jewelry and watches, crystal, pharmaceuticals, perfume, cosmetics, toys, collectibles, etc. Also, once the merchandise is removed, the container may be used in the home or shop, e.g. for storing loose things. Also, a through-slot, shown in phantom at 101 may be formed, communicating with slot 102D, so that the container may be used, e.g. as a coin bank.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. A container for displaying an item comprising:

a first end cap comprising a protrusion shape located within a rim of the first end cap and a second end cap comprising a protrusion shape located within a rim of the second end cap, both the first and second end cap having a cross section;

a central portion press fit coupled to the first and the second end caps; and a merchandising card comprising a first end secured with the protrusion shape of the first end cap and a second end secured with the protrusion shape of the second end cap and carrying graphics or indicia extending between and secured in position in the end caps wherein the merchandising card detachably secures an item between the first end and the second end.

2. The container of claim 1, wherein the central portion comprises a transparent material.

3. The container of claim 2, wherein the transparent material comprises a thermoplastic.

4. The container of claim 1, wherein the end cap rims and the central portion are coupled using an interference fit.

5. The container of claim 4, further comprising protrusions on the end cap rims for engaging openings in the central portion.

6. The container of claim 4, further comprising a protrusion on the central portion for engaging an opening in the end cap rims.

7. The container of claim 4, wherein each end cap rim further comprises a groove for accepting the central portion.

8. The container of claim 1, wherein the end cap rims and the central portion are frictionally engaged.

9. The container of claim 1, wherein the end caps are molded.

10. The container of claim 1, wherein the central portion comprises a cross section selected from the group consisting of an oval, a circle, an ellipse, a square, and a polygon.

11. The container of claim 1, wherein the merchandising card comprises a plurality of openings.

12. The container of claim 1, wherein the end caps are capable of supporting the central portion in an upright position.

13. A container for displaying an item, comprising:

a merchandising card displaying graphics or indicia and having a first end and a second end wherein the merchandising card detachably secures an item between the first end and second end;

a first end cap comprising a depression shape located within the walls of the first end cap to secure the first end of the merchandising card and a second end cap comprising a depression shape located within the walls of the second end cap to secure the second end of the merchandising card; and a central portion press fit coupled to the walls of the first and the second end caps.

14. The container of claim 13, wherein the central portion comprises a transparent material.

15. The container of claim 14, wherein the transparent material comprises a thermoplastic.

16. The container of claim 13, wherein the walls of the end caps and the central portion are coupled using an interference fit.

17. The container of claim 16, further comprising protrusions on the end cap walls for engaging openings in the central portion.

18. The container of claim 16, further comprising a protrusion on the central portion for engaging an opening in the end cap walls.

19. The container of claim 16, wherein each end cap wall further comprises a groove for accepting the central portion.

20. The container of claim 13, wherein the end caps and the central portion are frictionally engaged.

21. The container of claim 13, wherein the end caps are molded.

22. The container of claim 13, wherein the central portion comprises a cross section selected from the group consisting of an oval, a circle, an ellipse, a square, and a polygon.

23. The container of claim 13, wherein the end caps are capable of supporting the central portion in an upright position.

* * * * *